US006955263B2

(12) United States Patent
Steinkogler et al.

(10) Patent No.: US 6,955,263 B2
(45) Date of Patent: Oct. 18, 2005

(54) METHOD FOR PROCESSING SHEET MATERIAL

(75) Inventors: Alexander Steinkogler, Munich (DE); Alfred Schmidt, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 131 days.

(21) Appl. No.: 09/971,582

(22) Filed: Oct. 9, 2001

(65) Prior Publication Data

US 2002/0040865 A1 Apr. 11, 2002

(30) Foreign Application Priority Data

Oct. 6, 2000 (DE) ..... 100 49 436

(51) Int. Cl.[7] ..... B07C 5/00
(52) U.S. Cl. ..... 209/534
(58) Field of Search ..... 309/534, 547, 309/584, 900; 194/206; 229/681, 76, 302, 229/307; 271/162, 163; 270/52.01, 58.33, 270/58.44

(56) References Cited

U.S. PATENT DOCUMENTS

| | | | | |
|---|---|---|---|---|
| 35,861 | A * | 7/1862 | Wilson | 229/71 |
| 657,214 | A * | 9/1900 | Emory | 229/80 |
| 3,576,972 | A * | 5/1971 | Wood et al. | 235/487 |
| 3,980,006 | A * | 9/1976 | Welch | 493/238 |
| 4,236,639 | A | 12/1980 | Boettge et al. | |
| 4,414,730 | A | 11/1983 | Ohmura et al. | |
| 4,664,417 | A | 5/1987 | Rosenstrach et al. | |
| 4,877,235 | A * | 10/1989 | Robinson et al. | 271/279 |
| 5,036,984 | A * | 8/1991 | Labarthe | 209/3.3 |
| 5,419,440 | A * | 5/1995 | Picoult | 209/583 |
| 5,917,930 | A | 6/1999 | Kayani et al. | |
| 5,926,392 | A * | 7/1999 | York et al. | 700/223 |
| 5,931,293 | A * | 8/1999 | Seelenmeyer | 206/308.1 |
| 6,003,677 | A * | 12/1999 | Foley | 209/2 |
| 6,065,672 | A | 5/2000 | Haycock | |
| 6,303,889 | B1 * | 10/2001 | Hayduchok et al. | 209/584 |
| 6,311,846 | B1 * | 11/2001 | Hayduchok et al. | 209/3.3 |
| 6,502,746 | B1 * | 1/2003 | Do et al. | 235/379 |

FOREIGN PATENT DOCUMENTS

| | | |
|---|---|---|
| DE | 31 37 667 C2 | 3/1988 |
| EP | 0 614 118 A1 | 2/1994 |
| EP | 0 788 075 A2 | 8/1997 |
| GB | 2 166 113 A * | 4/1986 |

* cited by examiner

*Primary Examiner*—Donald P. Walsh
*Assistant Examiner*—Joseph Rodriguez
(74) *Attorney, Agent, or Firm*—Bacon & Thomas

(57) ABSTRACT

A method for processing sheet material, in particular papers of value such as bank notes, checks, etc., wherein different groups of sheet material are processed one after the other, the different groups of sheet material being separated for processing. A container for each group of sheet material is used for separating and processing each group of sheet material. The separating means or container thus delimits the individual groups of sheet material clearly from each other. Designing the separating means as a container obtains reliable separation of the individual groups of sheet material. Since the different groups of sheet material are already clearly separated and grouped before actual processing, one can avoid mixups, misallocations and transfer errors as can occur with later, simultaneous grouping of the different groups of sheet material.

14 Claims, 5 Drawing Sheets

METHOD FOR PROCESSING SHEET MATERIAL

BACKGROUND OF THE INVENTION a) Field of the Invention

The present invention relates to a method for processing sheet material, in particular papers of value such as bank notes, checks, etc., wherein different groups of sheet material are processed one after the other, the different groups of sheet material being separated for processing.

b) Related Art

A method and bank note processing machine for processing different groups of bank notes is known for example from JP 62-82493 A. The different groups of bank notes correspond to deposits by different depositors which are separated by separation cards. The separation cards are inserted between the different deposits to separate them. The separation cards can be disposed at the beginning, the end or the beginning and the end of the group of bank notes forming the particular deposit. The separation cards can contain information for example on the depositor and/or the deposit. Furthermore, the separation cards are designed so as to be recognized automatically by the bank note processing machine during processing. When a separation card is recognized the bank note processing machine can enter in the books the associated group of bank notes for the corresponding deposit or depositor.

The known method has the disadvantage, however, that disturbances and erroneous results often occur during processing of different groups of sheet material despite the design of the separation cards because the separation cards cannot be recognized or the information of the separation cards not read by the bank note processing machine so that they are not accordingly taken into account. Further problems are caused by the fact that preparation, i.e. an operator's separation using the separation cards, is error-prone.

It is therefore the problem of the present invention to state a method for processing sheet material, in particular papers of value such as bank notes, checks, etc., by which different groups of sheet material are processed one after the other, the different groups of sheet material being separated for processing, which allows processing of the different groups of sheet material which is improved both with respect to the recognition of the different groups of sheet material by the bank note processing machine and with respect to the proneness to error during preparation by an operator. Furthermore, separating means are to be stated which can be used for separating the different groups of sheet material and are suitable for carrying out the inventive method.

The invention starts out from the idea of using a container for each group of sheet material for separating and processing each group of sheet material. The separating means or container thus delimits the individual groups of sheet material clearly from each other.

SUMMARY OF THE INVENTION

The advantage of the invention is to be seen in particular in that the proposed design of the separating means as a container leads to reliable separation of the individual groups of sheet material. Since the different groups of sheet material are already clearly separated and grouped before actual processing one can avoid mix-ups, misallocations and transfer errors as can occur with later, simultaneous grouping of the different groups of sheet material.

BRIEF DESCRIPTION OF THE DRAWINGS

Further advantages of the present invention result from the dependent claims as well as the following description of examples with reference to figures, in which:

DETAILED DESCRIPTION OF PREFERRED EMBODIMENTS OF THE INVENTION

In the following the processing of different groups of sheet material will be described by way of example with reference to the processing of different groups of bank notes, referred to as deposits in the following. The different deposits are separated from each other by separating means, for example separation cards. A bank note processing machine is used for processing the different deposits.

Figure 1:
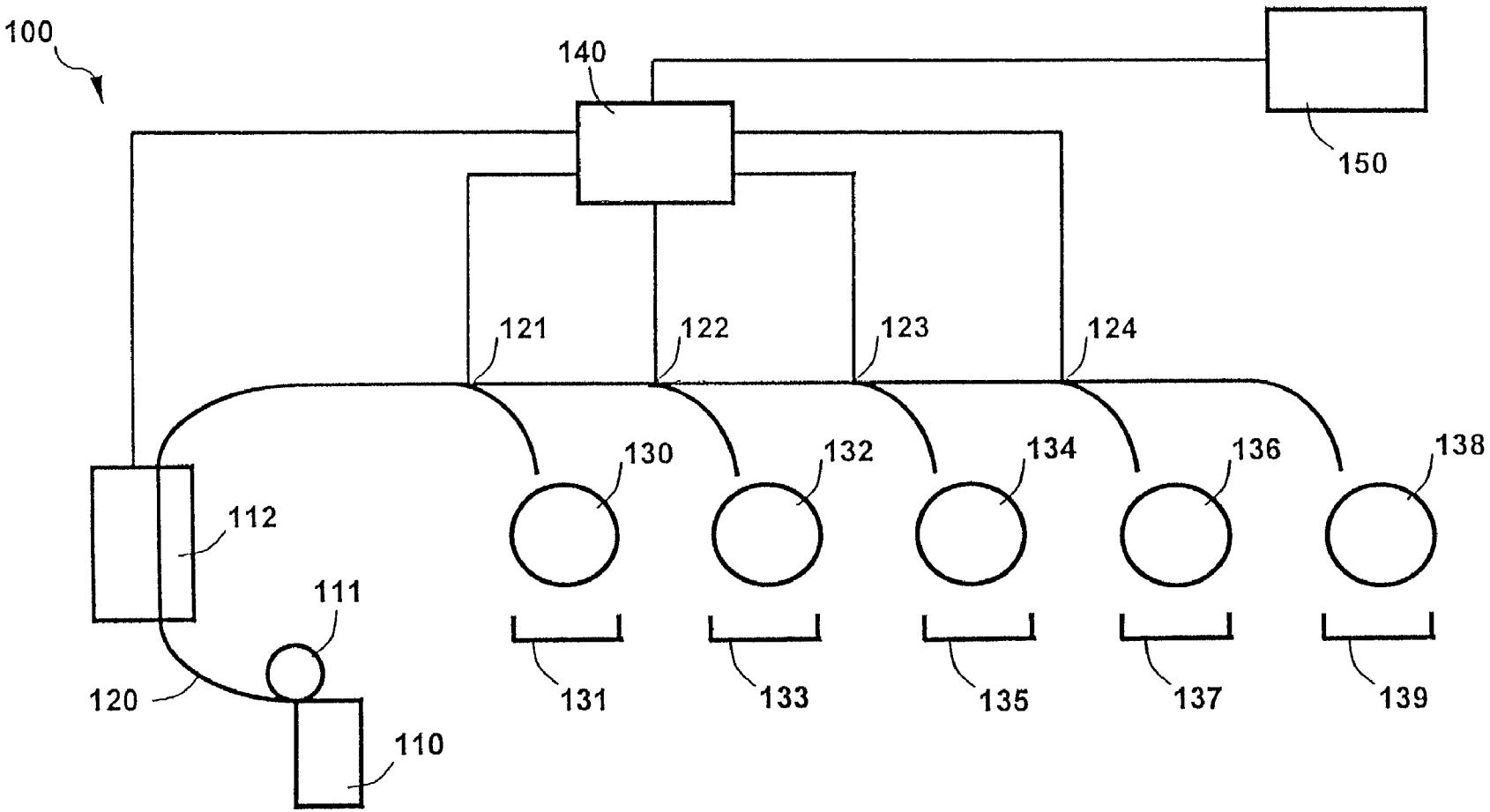
FIG. 1 shows a basic structure of a bank note processing machine for processing different groups of sheet material.

FIG. 1 shows a basic structure of bank note processing machine 100 for processing different groups of bank notes or deposits. Bank note processing machine 100 has input unit 110 in which the different deposits are inserted. Connected to input unit 110 is singler 111 which takes individual bank notes of the different deposits and the separation cards from input unit 110 and transfers them to transport system 120. Transport system 120 transports the individual bank notes and separation cards through sensor device 112 which determines data from the bank notes that indicate for example authenticity, state, denomination, etc. Furthermore, sensor device 112 recognizes the separation cards and detects information contained on the separation card. The determined bank note data and detected separation card information are delivered to control device 140 which evaluates the data and information and thus controls the further flow of bank notes and separation cards through bank note processing machine 100. For this purpose control device 140 acts on switches 121 to 124 which are elements of transport system 120 and allow the bank notes and separation cards to be stacked in output units 130 to 139 according to given criteria. Output units 130 to 139 can be formed for example as spiral slot stackers which stack the bank notes and separation cards to be stacked in bins 131, 133, 135, 137, 139 by means of rotating units 130, 132, 134, 136, 138 having spiral slots.

The separation cards are used—as mentioned above—to recognize the limits of different deposits during automatic bank note processing and to mutually delimit rejected bank notes, i.e. bank notes that have been classified as false or faulty during the check by sensor device 112 and control device 140.

The separation cards are vouchers that can be singled, transported and stacked like bank notes in bank note processing machine 100. They are designed to be clearly distinguished from bank notes and therefore recognized by bank note processing machine 100. The separation cards differ from the bank notes to be processed in physical properties such as size, shape and thickness, in print, color and pattern or other features such as magnetic areas.

A separation card can contain conductive elements that are printed on the separation card or applied in another way. Said conductive elements are reliably detected even in the case of multiple removal, i.e. when several bank notes or bank notes and separation cards rather than one bank note or separation card are grasped by singler 111, resulting in the separation cards being covered. It is of particular advantage if said patterns differ so clearly from conductive elements on bank notes (e.g. security threads or other applied conductive security elements) that the presence of a separation card is not erroneously indicated or an existing separation card missed in the case of multiple removal with partially overlapping bank notes. One way to achieve this is to apply several conductive bars to the separation card and effect the evaluation in such a way that a separation card recognition responds only if at least three or four of said bars are present. The use of conductive patterns has the advantage over known methods, e.g. based on magnetic bars, that conductivity is largely independent of the distance from the detecting measuring system and thus has higher reliability. Another advantage is that conductivity is detectable during a halt or very slow run of the transport system, while magnetic evaluation involves a dependence of signal strength on transport speed. Detection of such conductive elements can be effected for example by sensors that feed in a high-frequency electric field at one point and have a receiver for high-frequency fields at another point. If a conductive transmission path is present there is a capacitive coupling between transmitter and receiver and thus reliable detection.

Further possibilities for reliable recognition of a separation card are applied inductive elements or antenna coils. These can be wound in the form of a flat coil by a conventional method or printed as a coil using conductive ink. Detection can be effected for example by feeding in a high-frequency electric field and by the interaction of said coil in the form of an influence on the frequency of a resonant circuit formed with the transmitter elements.

Further possibilities for reliable recognition of a separation card are the formation of certain physical properties. These can be realized for example by a special stiffness of the carrier material to be detected by a force measurement at a deflection or in another way. Other recognition methods can be based on a special form e.g. in the behavior of sound reflection, the production of special soundwaves during bank note transport or by special behavior when exposed to electromagnetic waves.

The separation cards are inserted during preparation between the groups of bank notes of the different deposits that are to be separately tested and accounted for. The separation cards can be used as leading cards, i.e. at the beginning of a deposit, or trailing cards, i.e. at the end of a deposit, or in a combination of these two variants. During preparation the data of the deposits are normally collected. The deposit data can be present for example in the form of an accompanying slip (delivery note). Said data can be applied by hand or printed in machine-readable fashion, but they can also be already known because the depositor has reported the data of the deposit by telephone (telebanking) or in another way. Data allocation is produced on the separation card or information card e.g. by a unique mark, e.g. a bar code. In another case of application it may happen that the value of the deposit is unknown and to be detected only during bank note processing.

There are a number of possible ways in which the depositor can make the deposit data available for processing with bank note processing machine 100.

A first approach is for the depositor to already prepare a voucher that can be used as a separation card. Possibilities of doing so are special programs by which the depositor collects and enters in the books the data of his deposit and the program automatically executes a data transfer with the collected data to the service provider, e.g. via the Internet or other paths of telecommunication, and an accompanying slip is printed out at the depositor's which is enclosed with the deposit and can be used directly as a machine-readable separation card during bank note processing. On the basis of this data transfer the service provider receives a preview of the expected deposits and can accordingly reserve or adapt his processing capacity and estimate the presumably available stocks of money in order to make redeliveries or requests to a superior agency (e.g. the central bank) if necessary. The service provider can also be a value transport company that picks up the bank notes directly at the depositor's. In the course of this data transfer one can also produce an automatic communication to the depositor which states the presumable time of money pickup.

In this case the embodiment of a separation card with an embedded chip and transponder is of particular advantage. The information applied by the depositor (e.g. depositor identification, delivery identification, total nominal value, number of bank notes per denomination, account number, bank code number, etc.) can be read in its totality or as a subset by the machine and taken over for processing. This method has the advantage of eliminating preparations on bank note processing machine 100.

Figure 5:
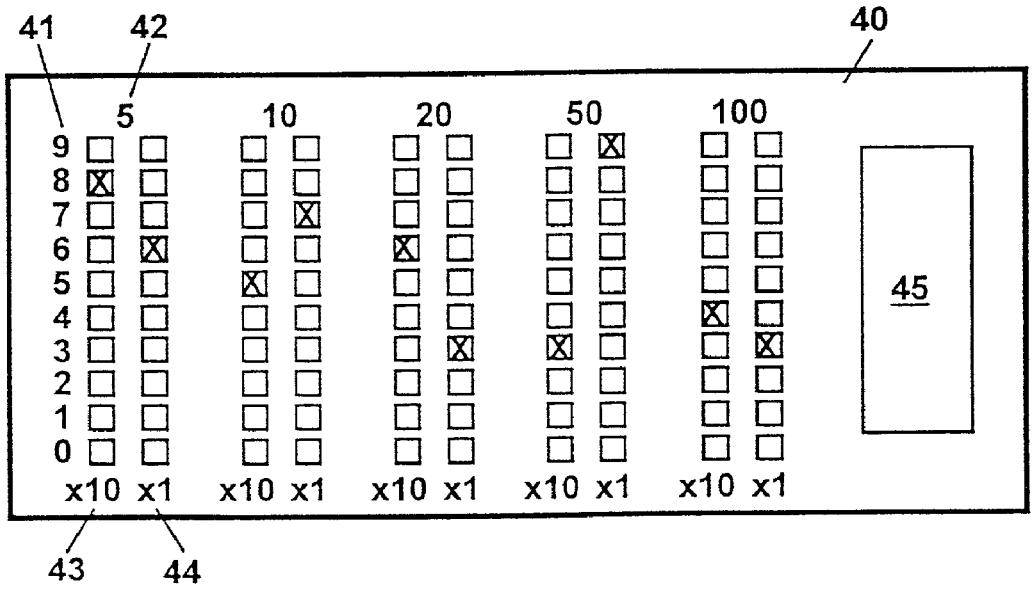
FIG. 5 shows a first embodiment for separating means and/or information means for collecting information for a group of sheet material.

In another variant, the depositor can for example fill in or check boxes on a preprinted separation card (in the manner of a lotto coupon) in order to mark the value of his deposit or the number of bank notes of the particular denominations. Such a separation card is shown in FIG. 5. Separation card 40 has boxes for each denomination. For denomination "five" 42, boxes are provided for numbers from "zero" to "nine" 41, which are evaluated with multiplier "one" 44 and a multiplier "ten." In the shown example there are 86 bank notes of the denomination "five." Further box 45 may contain data that e.g. identify the depositor.

Figure 2A:
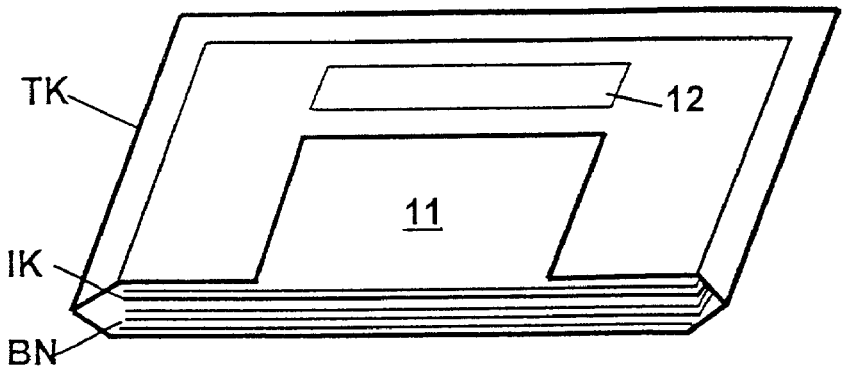
FIG. 2*a* shows a first embodiment of a separating means for a group of sheet material with an inserted group of sheet material.
Figure 2B:
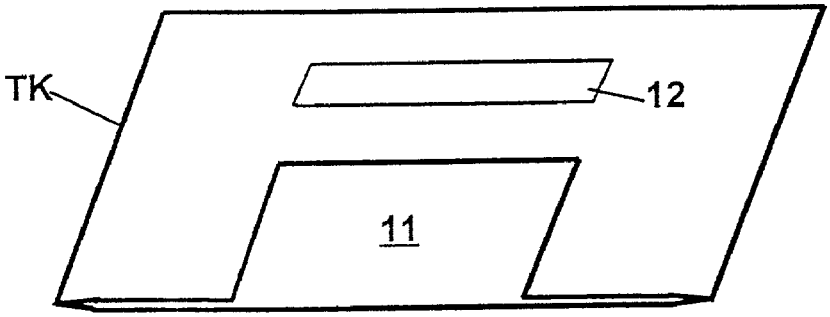
FIG. 2*b* shows the first embodiment of a separating means for a group of sheet material without inserted sheet material.
Figure 3:
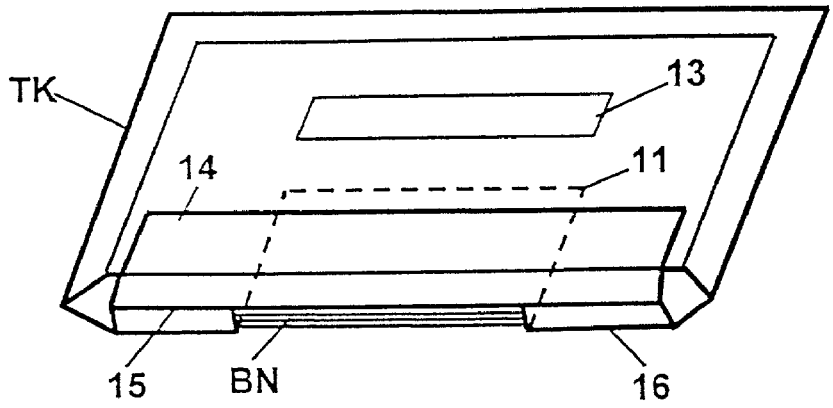
FIG. 3 shows a second embodiment of a separating means for a group of sheet material with an inserted group of sheet material.

FIGS. 2 and 3 show further embodiments of separation cards. Separation cards TK are formed in the shown cases as containers, in particular envelopes or covers of paper, cardboard or plastic foil.

As shown in FIG. 2*a,* bank notes BN of a deposit are inserted into the envelope. In addition to bank notes BN the envelope may contain one or more information means IK whose purpose will be explained below. Envelope TK moreover has gap 11 which singler 111 can engage to take the sheet material singly out of the envelope opening. When the total sheet material is taken out, as shown in FIG. 2*b*, singler 111 grasps the envelope on the side of the envelope opposite gap 11.

A variant of container or envelope TK is shown in FIG. 3. Envelope TK is equipped with closure 14 which is closed after insertion of a deposit into envelope TK. This permits the deposit to be transported by envelope TK safe from access. The use of such an envelope TK is expedient in particular for the receipts of a single cashier or the daily receipts of a single cash register which are then combined as a subunit with the receipts of all other cash registers, which are likewise inserted into envelopes TK and form subunits, into one deposit and supplied to bank note processing machine 100. The deposit with subunits which have come about e.g. at the same depositor's at different cash registers or on the responsibility of different cashiers is accounted for altogether or separately for the subunits in accordance with agreements made with the depositor. For processing in bank note processing machine 100 it may be provided that a cutting tool is disposed in singler 111 for opening closure 14 of envelope TK before singling begins. The cutting tool may cut open closure 14 for example along line 15 shown in FIG. 3. Closure 14 may also be completely removed by the cutting tool, however. It is likewise possible for the closure to be removed by an operator before processing. For this purpose a perforation may be present, for example along line 16 shown in FIG. 3, which allows closure 14 to be detached from envelope TK.

In a special embodiment, containers or envelopes TK can be designed so as to carry information that can be read by machine, for which purpose data fields 12 and/or 13 can be present on one or both sides of envelope TK for example. Closures 14 can also have data fields which have the same information as associated envelopes TK. Then it is possible for closures 14 to be also used in bank note processing machine 100 to be stacked in the output units together with the bank notes so that the bank notes can be assigned to the particular deposits. Closures 14 can for this purpose either be automatically taken into account and transported by bank note processing machine 100, or placed by the operator into one of the output units. This makes it possible to separate both accepted bank notes and unaccepted bank notes of individual deposits by envelopes TK or closures 14.

Figure 4:
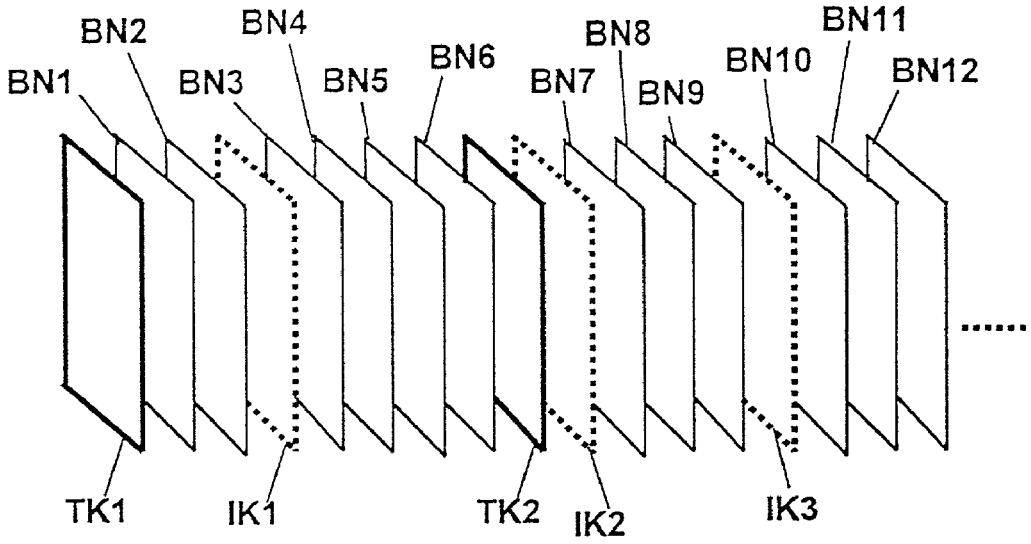
FIG. 4 shows an arrangement of several groups of sheet material with associated separating means and information means.

With reference to the structure of groups of sheet material or deposits shown in FIG. 4 the function of the abovementioned information means will be described in more detail. FIG. 4 shows a first deposit comprising separating means TK1, bank notes BN1 to BN6 and information means IK1 located between bank notes BN2 and BN3, and a second deposit comprising separating means TK2, bank notes BN7 to BN12 and two information means IK2 and IK3. Last bank note BN12 may be followed by further deposits, as indicated in FIG. 4 by a dotted line.

Separating means TK1 and TK2 can be formed as separation cards, as shown in FIG. 4, or as containers, as described above in connection with FIGS. 2 and 3. Separating means TK1 and TK2 are recognized by sensor device 112 with reference to specific properties, as described. They can moreover have information which can be used for identification of the deposits. This information on the separating means can be omitted, however, since additionally used information means IK1 to IK3 have corresponding information. Separating means TK1 and TK2 are then used only for separating different deposits, whereas information means IK1 to IK3 are used for providing the information required for processing. This makes it possible for corresponding information means IK1 to IK3 to be already prepared and provided with the desired information by the depositor from whom the particular deposit comes. During later processing of the different deposits with bank note processing machine 100 an operator then merely inserts separating means TK1 and TK2 between the individual deposits. Separating means TK1 and TK2 can already be inserted by the depositor, however, in particular with the above-described use of containers as separating means. The coding of separating means or information means with the information identifying the deposits can be done in the way described in connection with separation cards above or below. In the simplest case, the information means can also be formed by a part of the sheet material itself, for example the serial number of a bank note can be used for unique identification. The corresponding data, such as depositor, deposited amount, etc., are then assigned to the serial number in controller 140 of bank note processing machine 100 for processing.

As shown in FIG. 4, the information means can be disposed at any desired places within the particular deposit, after the separating means. In the first deposit information means IK1 is located for example after separating means TK1 and bank notes BN1 and BN2. In the second deposit information means IK2 is located directly after separating means TK2 and another information means IK3 between bank notes BN9 and BN10. Through the use of two information means IK2 and IK3 within the second deposit one can thus also form subunits of bank notes BN7 to BN9 and BN10 to BN12. In the same way further information means can be used to form further subunits. Said subunits can correspond for example to individual cash registers of a supermarket which together form the deposit of the supermarket.

In the following, different possibilities for coding and evaluation of separating and information means will be described, said means always being referred to as separation cards for simplicity's sake.

Separation cards or information cards can be provided with information. Said information can be an identification code that permits an indirect link with the data of the deposit held in another system. Said identification code can have been previously printed on, or be produced during preparation with the aid of an apparatus for coding separation cards. Additionally or alternatively, the separation card can contain direct information on the deposit (customer name, nominal value, number of bank notes separated according to denomination, etc.) and be used as a receipt for settlement. Said information can be applied in the form of a machine-readable bar code, information on a magnetic stripe or machine-readable fonts (OCR fonts).

Figure 6:
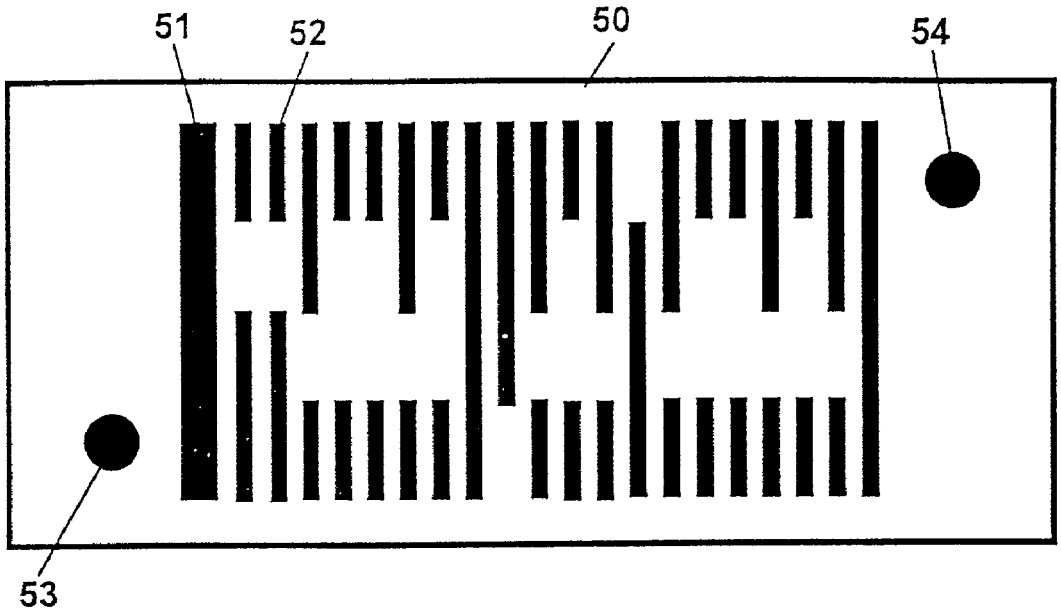
FIG. 6 shows a second embodiment for separating means and/or information means for collecting information for a group of sheet material.
Figure 7:
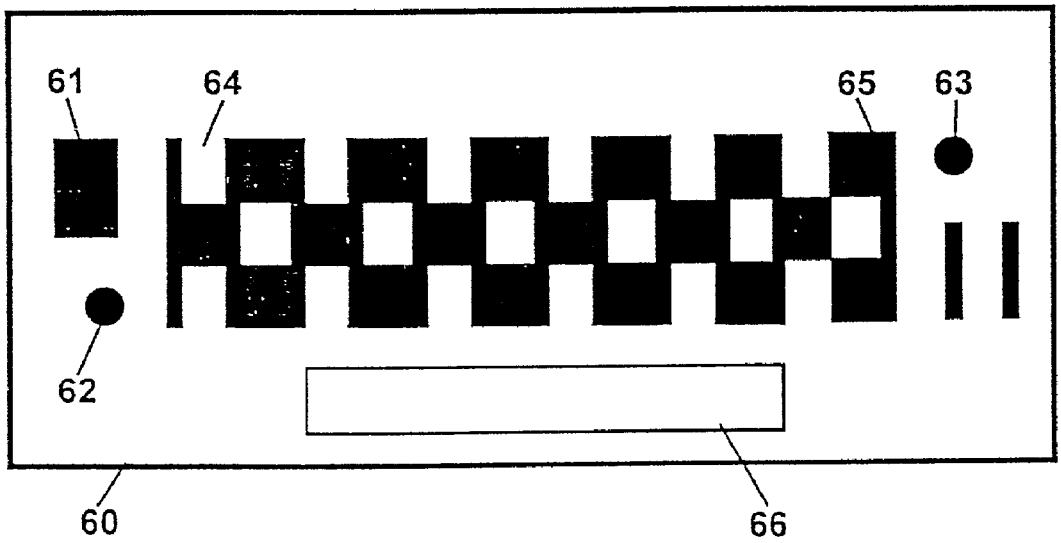
FIG. 7 shows a third embodiment for separating means and/or information means for collecting information for a group of sheet material.

Further possibilities for individual identification of the separation card include machine-readable information establishing a unique reference to a deposit e.g. by a two-dimensional bar code. This permits either the amount of information to be clearly increased or the information to be coded so that it can also be read by a sensor device with low resolution. Separation card 50 with such a two-dimensional bar code is shown in FIG. 6. Orientation marks 51, 53, 54 are provided to permit position-independent evaluation of two-dimensional bar code 52. Further separation card 60 with a two-dimensional data block matrix is shown in FIG. 7. Separation card 60 also has orientation features 61, 62, 63. The information is contained in the two-dimensional data block matrix having several data blocks 64 to 65. Between individual data blocks 64 to 65 one can dispose magnetic or electroconductive stripes which allow recognition even upon covering by multiple removal, as described above. Further information, e.g. in plaintext, may be contained in additional field 66.

Another possibility for applying and reading information on a separation card is to use optical codings as are common in compact discs for example. This technology permits a very large amount of information to be applied to a very small area and read optically, for example with a laser.

Another possibility for applying and reading information on a separation card is to use methods with place- and/or intensity-dependent features on the separation card. For example, one can use the arrangement and size of conductive elements on the separation card for individual coding of separation cards. This method can be expanded if said elements have different states of conductivity and the value of conductivity is detected and evaluated by a corresponding evaluation method. A similar method can be performed with the aid of magnetic elements.

Another possibility is to use optically visible prints which differ clearly in shape, arrangement, intensity and spectral property (color) and thus allow individual identification.

A very advantageous embodiment of a separation card results from using a chip embedded on the separation card with a transponder. The transponder is applied to the separation card in the form of a coil or antenna and connected with a chip embedded in the separation card. Said coil or antenna serves firstly to feed energy for supplying the embedded chip with power, secondly to transfer data to the chip (write information), thirdly to transfer information stored on the chip (read information), and fourthly to reliably recognize the presence of a separation card in accordance with the above explanations. The chip is a component that can store and/or process information. This embodiment results in a number of advantageous features for a separation card application since it permits many times more information to be stored than in information based on a bar code or OCR font for example. In addition, the method allows writing access to the separation card information and thus for example the addition of information in processing machine 100. In a first step one can write information on the depositor, nominal amount of the bank note value or nominal number of the particular denominations and identification information for example during preparation of processing. During machine processing this information is read wholly or partly by processing machine 100 and in a further step supplemented through writing access in machine 100 by further processing data, for example the particular number of bank notes recognized as authentic in terms of value and stacked. Said separation card is thus stacked in the special output unit and contains all information on the final settlement and entry in the books of the deposit.

This method has the further advantage over all known methods that the information can be read and written even if the separation card might be masked by bank notes, thereby eliminating the need to stop the machine and input the information subsequently.

This method furthermore offers the possibility of giving the separation card a corresponding credit entry that the depositor can use further like a credit on a money card. Another advantage of such a separation card with an embedded chip is the possibility of reading or writing with a customary read/write device that can be used during preparation and manual reworking.

A number of deposits can also be combined into one processing unit and collected in a deposit box. The deposit box can be used as a physical aid for transporting the deposits or constitute a unit of processing that is self-contained logically and in terms of accounting. For this purpose the deposit box is assigned a processing number which is associated with the deposit box for example by means of a bar code or stored in a chip mounted on the deposit box. This makes the deposit box an organizational aid for checking the processing process so that the processing state of a deposit can be detected anytime.

The deposit boxes or bank note stacks consisting of several deposits are supplied to singler 111 of bank note processing machine 100. The bank notes and the separation cards are singled by bank note processing machine 100 sequentially, in the order of the stack. The bank notes fit for circulation and those unfit for circulation are separated according to denomination and position and accordingly counted in output units 132 to 139. Bank notes which bank note processing machine 100 was unable to recognize clearly as authentic as well as bank notes suspected of being forgeries are collected in special output unit 130, 131.

Separation cards are distinguished from bank notes and recognized by sensor device 112 of bank note processing machine 100 due to their special features. Special features, e.g. magnetic stripes, and matching special evaluation methods of sensor device 112 ensure that a separation card is reliably recognized even when covered on both sides by bank notes in case of multiple removal.

The information on the separation card is likewise read by sensor device 112. If bank note processing machine 100 has recognized a separation card but was unable to read the information on the separation card properly, singling can be stopped and the operator asked to enter the unread information manually. Bank note processing machine 100 indicates a list of recognized separation cards by means of input/output device 150 and marks the unread separation cards therein. The operator looks for the unread separation card(s) in special output unit 130, 131 and inputs the information by means of input/output device 150. The operator can be supported by special readers, e.g. a bar code reader that is part of the input/output device.

The presence of a separation card indicates the end of processing of a first deposit and the beginning of a second deposit. The data of the stacked bank notes for the first deposit as well as the information on the associated separation card are stored for later evaluation in controller 140. The separation card is stacked in special output unit 130, 131 and separates rejected bank notes of the first deposit from rejected bank notes of the second deposit for later reworking, which can be done at a separate workplace for example.

If the separation card is a trailing card, the number of stacked bank notes can optionally be stored on the magnetic stripe of the separation card. This is done by a special writing apparatus integrated into transport system 120 of bank note processing machine 100.

If the separation card is a trailing card and no reject cases have occurred in the first deposit, the separation card can be stacked in another output unit to simplify manual reworking. E.g. the accepted bank notes can be separated in output units 132 to 139 so that they can also be assigned to the individual depositors after processing.

Upon recognition of a separation card, singler 111 of bank note processing machine 100 can optionally be stopped for the rejected bank notes of the deposit to be checked immediately. The separation card can be stacked in special output unit 130, 131 or in another output unit of the bank note processing machine. Immediate processing and detection of rejects avoids the danger of rejected bank notes of the first and second deposits being mixed and thus obtains very high accounting security. In this case, bank note processing machine 100 can also immediately check whether the nominal amount of the deposit matches the detected amount. In case of a deviation steps can be taken, e.g. the contents of the output units can be checked or the deposit taken from the output units and returned to the depositor. This can be done in clear fashion if the operator for example inserts a separating means into the output units at the end of processing of a deposit unit so that the beginning of a new deposit is clearly marked. In other embodiments, this separation can be effected by machine, e.g. by insertion of a separating finger, or the safely accounted for bank notes being pressed (stamped) into a collecting box.

When the end of a bank note stack with several deposits is reached, the bank notes and separation cards are taken from special output unit 130, 131 and manual reworking performed. This can be done on the bank note processing machine or at a separate workplace. The information on the separation card can be detected by means of a bar code reader for example. The worker takes out the bank notes belonging to a separation card, evaluates the bank notes in accordance with their denomination and authenticity and inputs said data. As soon as the worker has finished the input for a deposit, the deposit value detected on the machine and that detected during manual reworking can be added up and compared with the nominal value inputted during preparation, and any deviation detected and recorded.

Figure 8:
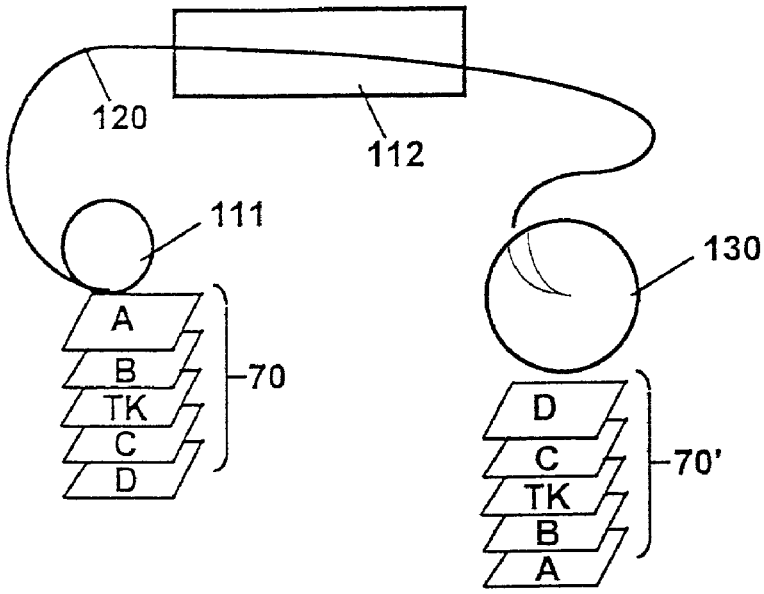
FIG. 8 shows a first embodiment of a bank note processing machine which does not change the order of sheet material during processing.
Figure 9:
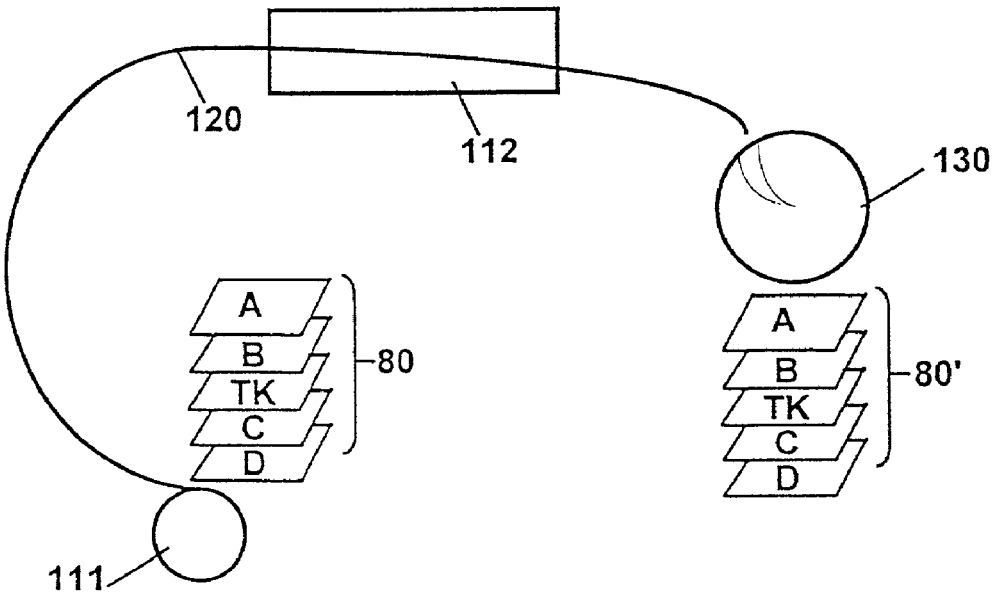
FIG. 9 shows a second embodiment of a bank note processing machine which does not change the order of sheet material during processing.

To simplify manual reworking it is expedient to reduce the number of vouchers to be processed as greatly as possible. One possible solution is to resupply the bank notes and separation cards stacked in special output unit 130, 131 to singler 111 and process them by machine in a rerun. Experience has shown that more than half of the bank notes rejected in the first run are then recognized as authentic, accordingly stacked and accounted for. This method presupposes that the order of vouchers is not changed by singling, bank note transport and stacking, not even in the case of multiple removal. This can be obtained by a special geometrical design of transport system 120 and is dependent on singler 111 used. FIGS. 8 and 9 show possible embodiments of transport system 120. Singler 111 shown in FIG. 8, which singles deposit 70 beginning with uppermost bank note A, requires a reversal in transport system 120. The order of deposit 70' resulting in output unit 130 then corresponds to the original order of deposit 70; but before repeated singling the stack of deposit 70' must be turned 180°. For singler 111 shown in FIG. 9, which singles deposit 80 beginning with lowermost bank note D, the original order of deposit 80 results automatically in output unit 130 for deposit 80' stacked there.

It is also possible to perform several reruns in order to further reduce the number of vouchers remaining for manual reworking. Controller 140 of bank note processing machine 100 adds up the results of the stacked bank notes of all runs for each deposit, so that repeated processing is not to be taken into account for the following processing steps and calculations.

In following steps for completing the accounting, the depositor obtains a credit of the deposit value, a confirmation of the credit for the deposit or a correction of the credit with a deviation message for the deposit. Depending on the design of the system, this information can also be conveyed electronically, by fax or by sending a communication.

Deposits normally consist of several denominations. With large bank note volumes, the individual denominations are first presorted and frequently combined into one-denomination packets of 100 bank notes each. An arbitrary mixture of denominations in consecutive bank notes generally only occurs with deposits from a deposit machine or vending machine. For practical reasons (ease of recounting) the deposits are usually structured so as to initially contain the bank notes of the same denominations in packets. Bank notes beyond the fill number 100 are also combined in one-denomination sets as residual bank notes. This regularity can be utilized advantageously in many ways.

Knowledge of the size of the deposit (known number of bank notes per denomination) permits the bank note processing machine to estimate reliable probabilities of which denomination values will presumably be the next notes to be singled. This knowledge can be optimally utilized if for example only one output unit is available for a certain denomination and the output unit cannot receive any notes during a banding process. Conventional methods involve the possibilities of the notes being sent into an alternate output unit (usually the special output unit) and singling optionally being stopped until the output unit is ready again. This may be up to ten or fifteen notes depending on the existing boundary conditions of the bank note processing machine, because the entire transport path must first be run empty.

With consideration of the structure of the deposit (order and particular number of bank notes per denomination), processing by the bank note processing machine can be optimized in such a way that it is already tested before the number of bank notes necessary for banding is reached whether enough bank notes of the just sorted denomination are still present in the particular deposit. In the positive case, singling can be stopped early enough for the output unit to receive just the number of bank notes necessary for banding and no or very few bank notes to be sent into the alternate output unit. If the test yields that the number necessary for banding will probably not be reached because a change of denomination is imminent, the bank note processing machine can continue singling at full speed. No overflow bank notes then occur because the further bank notes of the other denomination are passed into another output unit anyway.

A potential problem in separation card processing is caused by the change of stacking order in special output unit 130, 131. This can occur in particular with poor bank note qualities when bank notes are singled together with separation cards or bank notes are not stacked flat on preceding bank notes but remain upright in special output unit 130, 131. This changes the order, and it is not ensured that bank notes are stacked in the proper position relative to the particular separation card.

With continuous charging of one special output unit 130, 131 it is very difficult to define a time for checking consistent stacking since new bank notes or separation cards can constantly be arriving so that one cannot perform a test for example by a light barrier connected with controller 140 because no time can be defined when the beam path must be free. A frequently occurring case is that a bank note or separation card stays vertical. When following bank notes or separation cards are stacked the order of a deposit might be changed.

One method for solving this problem is to use at least two special output units 130, 131 and 132, 133 that are charged alternately. When a separation card is recognized and thus at the beginning of a new deposit, the other special output unit is switched to. This gives a monitoring control means the possibility of performing a check of stacking in the resulting gap in the special output unit not being charged. This check can be done for example by testing with the aid of the light barrier or an image evaluation whether the bank notes and separation cards are lying on each other properly and flat in the bin. In the case of deviation, singling is stopped and the operator asked to check and correct stacking.

Another method for solving this problem is direct recognition of the separation card during or shortly after singling. Such recognition is based on a search for the distinctive features of the separation card such as conductive or magnetic elements or signals of a coil or the transponder of an embedded chip.

If said recognition takes place in time for singler 111 to be stopped early enough for no further bank note to be singled, a gap can be forced to arise in the bank note stream and thus also in the stacking in the special output unit. This gap can be used for testing with the aid of the light barrier or image evaluation whether the sheets are lying on each another properly and flat in the output unit. In the case of a deviation, singler 111 remains stopped and the operator is asked to test and correct stacking. Singling is only continued after correction or release by controller 140.

Despite all precautions for ensuring an unchanged order of stacking in the special output unit, the order can be mixed up, resulting in misallocation of a bank note to a deposit. This leads to differences between the nominal amount and the actual amount determined during processing. It is expedient in this case to organize the bank note processing of deposits according to deposit boxes and ensure by organizational measures that the bank notes of one deposit box cannot be mixed or confused with bank notes of another deposit box in the process run. On this condition, mix-ups can only occur within a deposit box.

For recognition and correction of mix-ups within a deposit box, deficits are analyzed. A mix-up first causes a deficit in one deposit and a surplus in another deposit. The method is to determine the existing differences in a deposit box by corresponding data reduction through controller 140 and display them on input/output device 150. If positive and negative differences with the same value have occurred in consecutive deposits, these are probably spurious differences that can be resolved by book transfer of one or more bank notes. If several differences have occurred in a deposit box or in the non-immediate neighborhood, there are more complicated shifts. This problem is solved by presenting in a table all deposits with differences in the order in which they were processed by bank note processing machine 100. All available data are displayed, such as nominal amount, actual amount, difference, nominal number per denomination, actual number per denomination, unusual occurrences during processing (e.g. vertical bank note in the special output unit), etc. The data reduction program of controller 140 can determine from logical connections a proposal of which mix-ups have presumably occurred and accordingly present a proposed correction via input/output device 150. The correction is executed by the operator performing corresponding book transfers between the deposits by means of input/output device 150 and thus eliminating the effects of the mix-ups. The data reduction program ensures that only logically meaningful book transfers can be performed and the secured accounted for value for each deposit box is not changed.

Another method for resolving such mix-ups is to use additional separation cards within a deposit. This can be done for example by inserting an additional separation card between the individual packets or denomination limits of a deposit. With this additional separation card an identification number is not absolutely necessary. The structure of the deposit results in clearer differentiation between real and spurious differences: If all deposits have the same fixed order of denominations, mix-ups always have different denomination values due to a neighborhood relationship.

This shall be explained briefly by an example. The deposits each consist of first, second and third denominations (in this order) and the latter are delimited from each other by an additional separation card. If the subunit of the third denomination of the first deposit shows a deficit and the subunit of the first denomination of the second deposit shows a surplus with a value corresponding to the third denomination, a mix-up of a bank note with the third denomination has most likely occurred. If the surplus in the subunit of the first denomination of the second deposit has appeared with a value corresponding to the first denomination, then it is much more likely that both differences are real differences and not caused by a mix-up.

What is claimed is:

1. A method for processing different groups of sheet material one after another, comprising the following steps:

separating the different groups of sheet material by inserting each group of sheet material into a container, said container having an opening and at least one gap comprising a recessed portion of the container adjacent the opening and defined on one side of the container, the gap having a depth extending into at least a portion of the container and a width less than a width of the opening;

processing the separated groups of sheet material, the step of processing the sheet material including singly accessing the sheet material first through the gap of the container and then transporting the sheet material through the opening for removal; and transporting the container along with the sheet material after singling all the sheet material therefrom.

2. The method according to claim 1, wherein the separation and the processing of the groups of sheet material are effected at different places.

3. The method according to claim 1, wherein the container is closed by a closure after insertion of a group of sheet material.

4. The method according to claim 3, including opening the closed container.

5. The method according to claim 4, including opening the closed container by removal of the closure.

6. The method according to claim 5, wherein a particular group of sheet material and the closure are outputted together into a second output unit so that closures of containers of respective groups of sheet material separate accepted sheet material of particular groups of sheet material.

7. The method according to claim 5, wherein a particular group of sheet material and the closure are outputted together into a second output unit so that the closures of containers of respective groups of sheet material separate unaccepted sheet material of particular groups of sheet material.

8. The method according to claim 1, wherein a particular group of sheet material and a respective container are outputted together into a first output unit so that containers of respective groups of sheet material separate accepted sheet material of particular groups of sheet material.

9. The method according to claim 8, including taking sheet material separated by the containers or the closures thereof of respective groups of sheet material from the output unit or units and reprocessing them.

10. The method according to claim 1, wherein a particular group of sheet material and a respective container are outputted together into a first output unit so that containers of respective groups of sheet material separate unaccepted sheet material of particular groups of sheet material.

11. The method according to claim 1, wherein at least one information element is additionally inserted into the container.

12. The method according to claim 11, including inserting the information element at arbitrary places within the group of sheet material in the container.

13. The method according to claim 11, including forming subgroups of sheet material by the use of several information elements within the group of sheet material in the container.

14. The method according to claim 11, wherein the information element is formed by a part of the sheet material itself.

* * * * *